United States Patent [19]

Gil Buj

[11] Patent Number: 4,953,725

[45] Date of Patent: Sep. 4, 1990

[54] CHILDREN'S DRINKING VESSEL

[76] Inventor: Elena M. D. M. D. Gil Buj, 105 Carretera General, Hermigua, Gomera, Tenerife, Spain

[21] Appl. No.: 349,828

[22] Filed: May 10, 1989

[30] Foreign Application Priority Data

May 10, 1988 [ES] Spain ..... 8801480

[51] Int. Cl.[5] ..... A47G 19/22

[52] U.S. Cl. ..... 215/1 A; 220/90.2; 229/103.1

[58] Field of Search ..... 215/1 A, 11.1; 220/90.2; 229/103.1; 604/77; D7/8, 46

[56] References Cited

U.S. PATENT DOCUMENTS

| | | | |
|---|---|---|---|
| D. 183,668 | 10/1958 | Whalen | D24/46 |
| D. 215,868 | 11/1969 | Frank | D7/8 X |
| 293,190 | 2/1884 | Moore | 220/90.2 |
| 962,641 | 6/1910 | Kaufmann | 220/90.2 |
| 2,599,919 | 6/1952 | Hucknall | 215/11.1 X |
| 2,673,563 | 3/1954 | Kwast | 604/77 |
| 3,558,033 | 1/1971 | Leeds | 229/103.1 |
| 4,016,998 | 4/1977 | Finch | 215/1 A X |
| 4,485,963 | 12/1984 | Panicci | 229/103.1 X |
| 4,607,755 | 8/1986 | Andreozzi | 215/1 A |
| 4,690,294 | 9/1987 | Jones | 220/90.2 |

*Primary Examiner*—Sue A. Weaver

*Attorney, Agent, or Firm*—Collard, Roe & Galgano

[57] ABSTRACT

A drinking vessel which contains a pipe integrally formed within its surface to serve as a drinking straw. The vessel may include a downwardly sloping ramp on the floor of the vessel, the ramp downwardly sloping toward the end of the pipe to allow the liquid contents to be directed toward the bottom of the pipe. The pipe extends upwardly above the entrance opening of the vessel and serves as a drinking straw.

3 Claims, 1 Drawing Sheet

CHILDREN'S DRINKING VESSEL

BACKGROUND OF THE INVENTION

This invention relates to a novel drinking cup for use by children. More specifically, this invention relates to a drinking cup having an upwardly directed pouring spout that consists of a pipe which is formed along the interior wall of the drinking vessel. The pipe opens at the bottom of the vessel and has contact with the liquid in the vessel so that the child can use the pipe as a straw to drink the contents of the vessel.

DISCUSSION OF THE PRIOR ART

It is known that for young children, it is easier to drink liquids such as juices, milk shakes, milk, etc., with the classic straw. Straws are very popular with children and families with youngsters know that they have to keep a stock of straws around to satisfy the demands of their children. It is not known why children prefer to drink liquids through straws over drinking from ordinary vessels.

The hand cup for children of the present invention solves the problem of having to provide straws by incorporating the classic straw into the design of the vessel. The vessel can take any shape, such as a glass or cup, as long as it incorporates the pipe into the vessel. This will allow the child to use the vessel without having to use a classic straw. The pipe constitutes an internal part of the vessel, and emerges upwardly from it. The pipe or tube is of small diameter and permits the child to suck drink and swallow in a comfortable, efficient, and easy manner.

Moreover, the vessel can be designed in the shape of a toy and can look like an animal, vegetable, etc., so as to attract the interest of the child to the vessel and its content. This novel shape can encourage the child in any involuntary way to drink the liquid food.

BRIEF DESCRIPTION OF THE DRAWINGS

Other objects and features of the present invention will become apparent from the following detailed description considered in connection with the accompanying drawing, which discloses the embodiment of the invention. In the drawing, wherein similar reference characters denote similar elements throughout the two views.

DETAILED DESCRIPTION OF THE INVENTION

Figure 1:
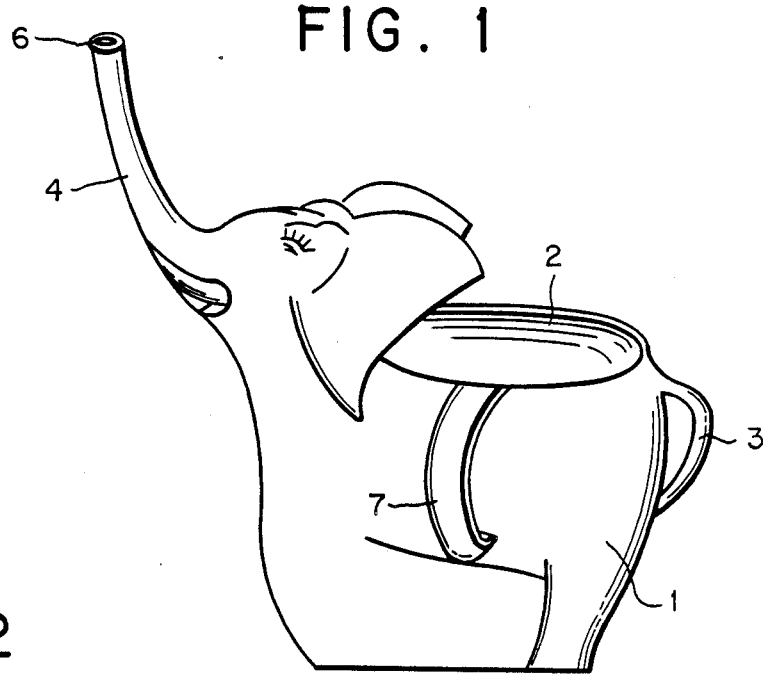
FIG. 1 is an upper prospective view of a vessel according to the invention for use by children and in this case, is shown in the form of an elephant.
Figure 2:
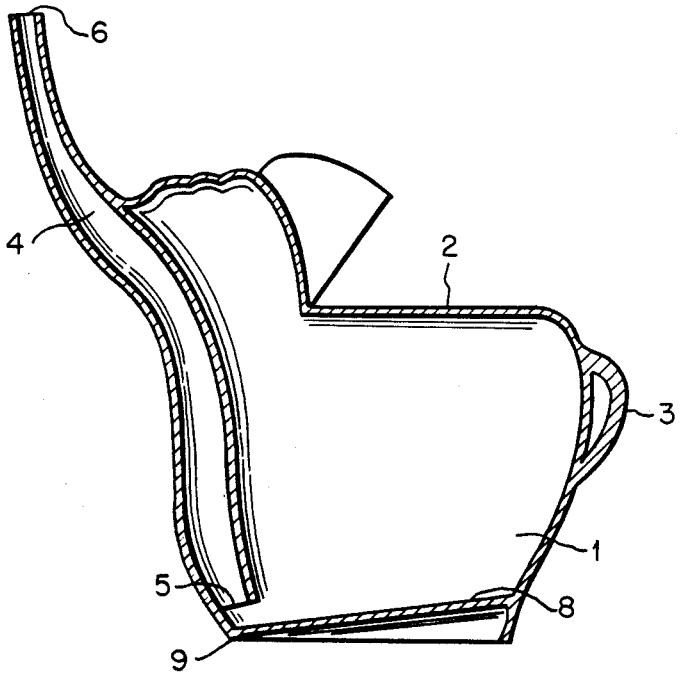
FIG. 2 is a cross-sectional view of the vessel of FIG. 1 which shows the view of the pipe that constitutes the classic straw or absorption straw.

Referring to FIGS. 1 and 2, there is shown a vessel 1 of the invention designed for children, and in the shape of an elephant. Since the purpose of the invention is to find an attractive vessel for the child, any other shape such as an animal or a classic glass could also be used.

Vessel 1 is provided with an opening 2 and a corresponding handle 3 of a pipe 4, directed upwardly and is mounted within the walls of the vessel and its lower part 5 is adjacent to the bottom of the vessel 1. The pipe is formed by the wall surface of the vessel, by partitioning the internal part. This internal pipe is formed of the same material as vessel 1. The upper portion of the pipe emerges from the vessel to define an exit end 6 through which the liquid contained in the vessel 1 can be drained out by the child in a comfortable, efficient and easy way.

Vessel 1 can also be decorated with complementary elements such as handles 7, in order to make it easier to handle by the child.

To aid the child in draining the total contents of the vessel, an incline plane 8, having a slope toward the absorption pipe 4, is provided so that it defines area 9 of maximum depression at the bottom of the vessel.

While only a single embodiment of the present invention has been shown and described, it will be obvious that many changes and modifications may be made therein to without departing from the sphere and scope of the invention.

What is claimed is:

1. A drinking vessel for containing a supply of liquid comprising an internal pipe integrally formed along the internal wall of the vessel and having a bottom opening adjacent to the bottom of the vessel and having a top opening protruding above the entrance opening of the vessel, said pipe defining a straw to allow the contents of the vessel to be drained out, said vessel having a slanting surface formed on the bottom of the vessel, said slanting surface sloping downwardly toward the bottom opening of said pipe, and said slanting surface forming the entire bottom surface of said vessel.

2. The vessel as recited in claim 1, additionally comprising one handle formed on the side of said vessel.

3. The vessel as recited in claim 2, wherein said vessel is in the shape of an animal object.

* * * * *